US012655579B1

(12) United States Patent
Weihrather et al.

(10) Patent No.: US 12,655,579 B1
(45) Date of Patent: Jun. 16, 2026

(54) FIRE-RATED FINISHING PRODUCT SUITABLE FOR FABRIC APPLICATIONS

(71) Applicant: Archroma International (Germany) GmbH, Langweid am Lech (DE)

(72) Inventors: Alfred Josef Weihrather, Langweid am Lech (DE); Reinhold Braun, Langweid am Lech (DE)

(73) Assignee: Archroma International (Germany) GmbH, Langweid am Lech (DE)

( * ) Notice: Subject to any disclaimer, the term of this patent is extended or adjusted under 35 U.S.C. 154(b) by 437 days.

(21) Appl. No.: 18/285,594

(22) PCT Filed: Apr. 6, 2022

(86) PCT No.: PCT/EP2022/059129
§ 371 (c)(1),
(2) Date: Oct. 4, 2023

(87) PCT Pub. No.: WO2022/214545
PCT Pub. Date: Oct. 13, 2022

(30) Foreign Application Priority Data

Apr. 6, 2021 (EP) ..... 21167009

(51) Int. Cl.
*D06M 13/00* (2006.01)
*D06M 13/447* (2006.01)
*D06M 13/53* (2006.01)
*D06M 101/06* (2006.01)

(52) U.S. Cl.
CPC ..... *D06M 13/447* (2013.01); *D06M 13/53* (2013.01); *D06M 2101/06* (2013.01); *D06M 2200/30* (2013.01)

(58) Field of Classification Search
CPC ..... D06M 13/447; D06M 13/53; D06M 2101/06; D06M 2200/30
USPC ..... 8/127.1
See application file for complete search history.

(56) References Cited

U.S. PATENT DOCUMENTS 3,579,532 A 5/1971 Nachbur et al.
3,800,010 A * 3/1974 Nachbur ..... C08G 18/3889 558/170
4,013,813 A * 3/1977 LeBlanc ..... D06M 13/447 558/158
4,177,300 A * 12/1979 Walsh ..... C07F 9/4075 558/170
10,227,482 B2 3/2019 Arechederra
2004/0058601 A1 3/2004 Parker

FOREIGN PATENT DOCUMENTS

CN 103572592 A1 2/2014
EP 0675891 B1 * 3/1997 ..... A61Q 19/00
JP 2006-500481 A 1/2006
TW 2014-28093 A 7/2014

OTHER PUBLICATIONS

STIC Search Report dated.*
International Search Report for corresponding European Patent Application No. PCT/EP2022/059129 dated Aug. 6, 2022. 2 pages.
Written Opinion for corresponding European Patent Application No. PCT/EP2022/059129. 5 pages.
International Standard, ISO-15025-2016. 11 pages.
Office Action from corresponding Taiwanese Patent Application No. 111112888 dated May 3, 2024.

* cited by examiner

*Primary Examiner* — Eisa B Elhilo
(74) *Attorney, Agent, or Firm* — Christensen Fonder Dardi; Elizabeth A. Gallo; Peter S. Dardi

(57) ABSTRACT

The present invention relates to a fire-rated finishing product suitable for fabric applications having following formula I:

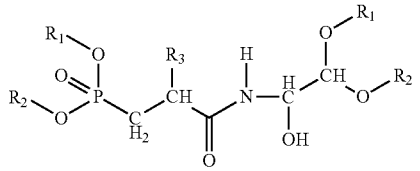

Wherein, $R_1$, $R_2$ are each a group equal to $—C_nH_{2n+1}$, wherein n ranges from 1 to 4, preferably equal to 1, and wherein $R_3$ is H or methyl group.

16 Claims, No Drawings

FIRE-RATED FINISHING PRODUCT SUITABLE FOR FABRIC APPLICATIONS

CROSS REFERENCE TO RELATED APPLICATIONS

This application is a National Stage filing of PCT Application No. PCT/EP2022/059129 filed Apr. 6, 2022, entitled "A Fire-Rated Finishing Product Suitable for Fabric Applications", which claims priority to European Patent Application No. 21167009.6, filed Apr. 6, 2021, which is incorporated herein by reference.

The present invention relates to a fire-rated finishing product suitable for fabric applications and to a process for processing cellulose-containing material with said fire-rated finishing product.

Cotton fiber is one of the most important natural fabric, which is widely used in people's daily life. Cotton fiber has a lot of advantages, in particular in terms of mechanical performances, biodegradability, gas permeability, dyeability and hydrophilicity. It is known that cotton fiber can be used in bedding, garment material, upholstery, such as carpet, cover for furniture, cushion, and so on.

However, cotton fabric has high burning rate, and this can seriously harm consumers. This drawback is currently alleviated by the application of flame-retardant chemicals onto the fabric.

It is essential that flame-retardant chemicals remain on the fabric after laundering and dry-cleaning operations.

Generally, the fixing rate of formaldehyde/phosphorus/nitrogen-containing retardant (e.g. Pyrovatex CP) in the presence of an added amount of formaldehyde-containing resin, when applied on fabrics, is between 50 and 60%.

For example, U.S. Pat. No. 3,579,532 relates to bis-phosphono-propionamide substituted ethylene glycols and imidazolidinones. It is provided phosphorus-containing products, which are obtained by reacting a starting material comprising phosphorus and nitrogen atoms with glyoxal, formaldehyde, urea and an etherifying agent. Unfortunately, the provided phosphorus-containing product, as disclosed in U.S. Pat. No. 3,579,532, has a fixing rate of phosphorous on fabrics after wash-off process of about 55% and high amount of phosphoric acid is used (around 25 g/L).

The known flame-retardant chemicals contain or emit formaldehyde-containing phosphorus compounds, which are hazardous to the environment and to health.

For these reasons, there is a need to provide a fire-rated finishing product suitable for fabric applications, which does not harm the environment and health and which provides higher yield, while guaranteeing durability after laundering and dry-cleaning operations of the fabric.

It is an object of the present invention to overcome the aforementioned drawbacks by providing the following product having formula I:

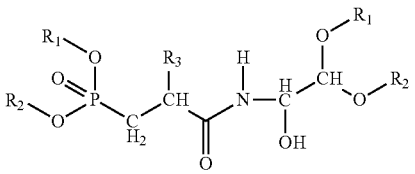

Wherein, $R_1$, $R_2$ are each a group equal to $—C_nH_{2n+1}$, wherein n ranges from 1 to 4, preferably equal to 1, and wherein $R_3$ is H or methyl group.

With the compound (product) of formula I of the invention, formaldehyde is no longer needed (in the product or even during the process of impregnation of the product onto fabrics), which is highly advantageous.

The product of the invention is efficient in terms of flameproofing properties, when applied on fabric, and durability, since it remains on the fabric, even after several washing operations, and laundering and dry-cleaning operations.

The fixing rate is surprisingly high enough (up to 70%) and the fixing step of the product on the fabric is also facilitated and greener for the environment, since less acid is needed. In other words, wastewater is less polluted by phosphorus, which makes the use of the product of the present invention attractive for the user.

Moreover, the use of formaldehyde-containing resin is no longer needed.

Preferably, the product of formula I of the present invention is obtainable (or obtained) by the following steps:

Providing a phosphorus-containing compound having the following formula II:

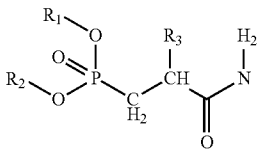

Wherein, $R_1$, $R_2$ are each a group equal to $—C_nH_{2n+1}$, wherein n ranges from 1 to 4, preferably equal to 1, and wherein $R_3$ is H or methyl group;

Reacting the compound of said formula II with the following acetaldehyde compound having formula III:

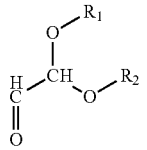

Wherein, $R_1$, $R_2$ are each a group equal to $—C_nH_{2n+1}$, wherein n ranges from 1 to 4, preferably equal to 1.

More preferably, said acetaldehyde compound is 2,2-dimethoxyacetaldehyde.

According to an advantageous embodiment of the invention, when said compound of formula III is reacted with said compound of formula II, the pH is adjusted to a value ranging from 7 to 10, preferably 8.5 to 9.

Advantageously, the yield of the reaction between said compounds of formula II and III is of at least 70%, preferably at least 85%, measured by HPLC.

More advantageously, the reaction between said compounds of formula II and III is carried out at a temperature ranging between 40 to 80° C., preferably between 50 to 70° C., more preferably at 60° C.

In a preferred embodiment, the reaction between said compounds of formula II and III is carried out during a period of time ranging from 0.5 to 4 hours, preferably from 0.5 to 3 hours, most preferably from 0.5 to 2.5 hours. This is particularly cost-efficient.

In a particularly preferred embodiment, the reaction between said compounds of formula II and formula III is carried out at a mole ratio ranging from 0.7 to 1.3. With such selection of mole ratio, the yield of the reaction between compounds II and III is improved.

More preferably, the product of the invention is substantially free of any added amount of formaldehyde or any formaldehyde derivatives. This is particularly advantageous for the environment and health.

Even more preferably, formula II of the invention is obtained by applying the following steps:

Reacting a compound having following formula IV:

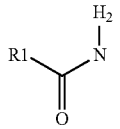

wherein $R_1$ is a hydrocarbon chain which comprises at least one carbon-carbon-double bond, preferably the latter is an end group of $R_1$, with a compound having the following formula V:

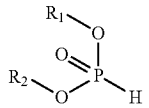

wherein, $R_1$, $R_2$ are each a group equal to $—C_nH_{2n+1}$, wherein n ranges from 1 to 4, preferably equal to 1.

Other embodiments of the product as disclosed hereinabove are mentioned in the annexed claims.

The present invention also relates to a process for processing cellulose-containing material comprising the following steps:

Mixing a product according to the present invention with an aqueous solution containing a catalyst, which comprises ammonium phosphate compound, or a mixture of catalysts in aqueous solution, which comprises ammonium phosphate compound and at least one pentavalent organic phosphorus compound, Applying the obtained composition on the cellulose-containing material and curing at a predetermined temperature.

Preferably, the ammonium phosphate compound is selected from the list comprising (or consisting of) ammonium phosphate, diammonium phosphate, monoammonium phosphate and mixtures thereof.

More preferably, said ammonium phosphate compound, preferably phosphoric acid, is present in an amount ranging from 1 to 20 g/L, preferably between 1 and 17 g/L, more preferably between 1 and 15 g/L, based on the total amount of said composition. This is particularly advantageous since low amount, lower than 20 g/L of ammonium phosphate compound, preferably phosphoric acid is used, meaning that less phosphorus is contained in wastewater, while keeping good results.

According to a particularly advantageous embodiment, the phosphorus fixing rate of said obtained composition onto the cellulose-containing material is of at least 65%, preferably at least 70%, preferably obtained without the presence of a resin containing formaldehyde.

One particularly preferred embodiment relates to the curing conditions when the obtained composition is applied onto cellulose-containing material (e.g. fabric). The predetermined temperature ranges between 150-170° C. or is preferably equal to about 160° C. Advantageously, the curing time ranges from 3 to 15 minutes, preferably 10 minutes.

According to an advantageous embodiment of the invention, the application of said obtained composition on said cellulose-containing material is carried out at a pH of above 3, preferably by foularding.

During the curing process the reactive hydroxy and acetal groups can react with the hydroxy groups of the cotton fiber. In addition to the product of the invention, an intermolecular crosslinking is also possible in combination with the ammonium salt formed during the process.

Other embodiments of the process of the invention as disclosed hereinabove are mentioned in the annexed claims.

Furthermore, the present invention also relates to a cellulose-containing material, which is obtained by the process of the invention, wherein said cellulose-containing material is substantially free of any added amount of formaldehyde or any formaldehyde derivatives.

Other embodiments of the cellulose-containing material as disclosed hereinabove are mentioned in the annexed claims.

The present invention relates to a (formaldehyde-free) flame retardant finishing product suitable for cellulose-containing materials, such as cotton or cotton blends (e.g., cotton/polyester and cotton/nylon), and durable to both laundering and dry-cleaning operations.

In the context of the present invention, the fire-rated finishing product can be provided in aqueous form when mixed with at least one wetting agent, a catalyst, preferably $NH_4H_2PO_4$, and ammonium phosphate compound, for instance phosphoric acid (e.g. 80 or 85%), advantageously diluted in water. The (aqueous) composition obtained may be applied to the textile fabric by conventional means, e.g. by foularding. The fabric is then squeezed to the desired take-up, dried and subjected to a dry-heat process at temperatures above 100° C. (see pad→dry→cure). The pH of the aqueous composition of the present invention used to impregnate the fabric is preferably brought above 3.

The impregnation is preferably evenly carried out onto the fabric.

The cellulose-containing materials can be impregnated on a pad mangle. Adequate liquor pick-up is preferred (50-70%, up to 90% on knit fabrics) and can be achieved by a combination of absorbent fabric and long contact of the goods with the liquor (padding speed/guide rollers).

Drying step can take place on stenter and can be carried out with maximum overfeed. The recommended drying temperature in the first zone is 110° C.; the temperature in the other zones should not be higher than 130° C. to minimize migration. The goods should, if possible, be processed in a partial vacuum (air extraction).

Curing can be carried out in a curing oven 5 minutes at 150° C. In the case of curing on stenter, a period of time between 45 to 60 sec. at 170° C. is sufficient.

According to a preferred embodiment, the impregnated goods can be washed off after curing, preferably within 24 h. Soda ash or caustic soda is added to the washing bath to neutralize the goods and to make the goods alkaline and therefore reduce hydrolysis of the finish during storage of the finished goods.

In order to achieve continuous neutralization, the goods can remain in the alkaline bath for at least 2 min. After neutralizing and rinsing, they should be slightly alkaline and have a pH of 8-9.

With the fire-rated finishing product of the present invention, the flameproofing properties can remain over time on the fabric, even after several washing operations, and laundering and dry-cleaning operations, making said product durable enough.

In the meaning of the present invention, the wording "being substantially free of any added amount of formaldehyde or any formaldehyde derivatives" should be understood as the given object containing less than 0.1 weight %, preferably less than 0.01 weight %, more preferably less than 0.001 weight % of formaldehyde or formaldehyde derivatives, based on the total weight % of the given object.

In the context of the invention, the HPLC/UV is carried out with Perkin Elmer Series 200 with an analytical balance AT 201 (Mettler-Toledo).

| HPLC-Parameter: Column: YMC-Triart C18 (150 × 3 mm/3 μm) Eluent: | | |
|---|---|---|
| Time [min] | Water | Methanol |
| 0 | 90 | 10 |
| 25 | 90 | 10 |
| Flow-rate | 0.4 ml/min | |
| Wave length: | UV-200 nm | |
| Inj. Vol.: | 10 μl | |
| Oven-temp.: | 30° C. | |
| Rt.: | 16.9 min | |

Sample preparation is as follows:

Weigh in about 0.1 g (Albegal B®, amphoteric leveling agent) of the test item into a 100 ml flask and fill up with water to the mark. 10 μl of the solution was injected and analysed by HPLC/UV.

UV detection: 210 nm.

EXAMPLE 1

In a reaction vessel 308.8 g (2.75 mol) dimethyl phosphonate and 8 g sodium methylate (30%) were stirred and heated to 45° C. Then, 181.44 g (2.55 mol) of acrylamide were added at this temperature and dissolved under stirring. In addition, 36.5 g of a 30% strength solution of sodium methylate in methanol were slowly added dropwise in the course of 3 hours. During this period of 3 hours, the temperature in the reaction mixture was increased to 70° C. When the reaction was complete, the methanol was distilled off.

After the distillation had ended, the mixture was cooled to 60° C.

487.2 g (2.81 mol) 2,2-dimethoxyacetaldehyde (60%) were added under stirring. The pH was adjusted to a value between 7.5 and 9.5 (ideally pH 9.0) with potassium carbonate (50%) and held for two hours at 60° C.

Yield of addition product: approx. 85% (HPLC).

Steps 1 and 2 illustrated below show the synthesis steps, leading to the formation of the fire-rated finishing product of the present invention.

Step•I

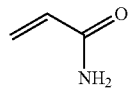

acrylamide
Chemical Formula: $C_3H_5NO$
Molecular Weight: 71, 0779

+

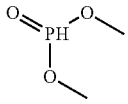

dimethyl phosphonate
Chemical Formula: $C_2H_7O_3P$
Molecular Weight: 110, 0489

$NaOCH_3$ →

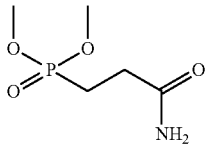

dimethyl (3-amino-3-oxopropyl)phosphonate
Chemical Formula: $C_5H_{12}NO_4P$
Molecular Weight: 181, 1268

Step•2

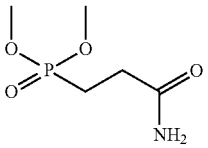

dimethyl (3-amino-3-oxopropyl)phosphonate
Chemical Formula: $C_5H_{12}NO_4P$
Molecular Weight: 181, 1268

+

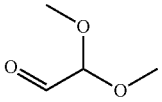

2, 2-dimethoxyacetaldehyde
Chemical Formula: $C_4H_3O_3$
Molecular Weight: 104, 1045 ph = 9 →
$K2CO_3$

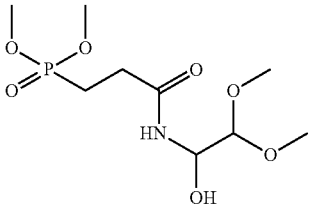

dimethyl (3-((1-hydroxy-2, 2-dimethoxyethyl) amino)-3-oxopropyl)phosphonate
Chemical Formula: $C_9H_{22}NO_2P$
Molecular Weight: 285,2314

EXAMPLE 2

The fire-rated finishing product of example 1 is applied onto a cotton fabric in the presence of a wetting agent, for instance INVADINE® PBN wetting agent from Huntsman, and a (mixture) of catalyst(s): $NH_4H_2PO_4$ and/or phosphoric acid (85%), as illustrated in tables 1 and 2 below. Sample 6—the reference—corresponds to an embodiment of the state of the art.

TABLE 1

| | UNIT | 1 | 2 | 3 |
|---|---|---|---|---|
| FIRE-RATED FINISHING PRODUCT OF THE INVENTION | G/L | 600 | 600 | 600 |
| PYROVATEX CP NEW (REFERENCE) | G/L | 0 | 0 | 0 |
| KNITTEX MLF NEW (RESIN) | G/L | 0 | 0 | 0 |
| INVADINE PBN | G/L | 5 | 5 | 5 |
| $NH_4H_2PO_4$ (20%) | G/L | 100 | 100 | 150 |
| PHOSPHORIC ACID 85% | G/L | 5 | 15 | 0 |
| WORKING PROCESS | | PAD → DRY → CURE 10 MIN 165° C. SURFACE TEMPERATURE | PAD → DRY → CURE 10 MIN 165° C. SURFACE TEMPERATURE | PAD → DRY → CURE 10 MIN 165° C. SURFACE TEMPERATURE |
| PICK UP: 100% CO TWILL/ 249 G/M ID: 001-CO/240 BE $14^2$ | | 82% | 82% | 82% |
| WASH-OFF: | | SEPARATE 10 G/L SODA ASH LR 1:20 20 MIN AT 60° C. RINSE WARM, COLD | SEPARATE 10 G/L SODA ASH LR 1:20 20 MIN AT 60° C. RINSE WARM, COLD | SEPARATE 10 G/L SODA ASH LR 1:20 20 MIN AT 60° C. RINSE WARM, COLD |
| PH-VALUE/FLOTTE | | 4.8 | 3.3 | 5.8 |
| P CONTENT | | P [%] | P [%] | P [%] |
| INITIAL | | 1.90 | 2.12 | 2.04 |
| AFTER 25 × 60° C. 2A (WASHCATOR/SAPTON) | | 1.80 | 2.08 | 2.07 |
| N CONTENT | | N [%] | N [%] | N [%] |
| INITIAL | | 0.76 | 0.89 | 0.82 |
| AFTER 25 × 60° C. 2A (WASHCATOR/SAPTON) | | 0.72 | 0.83 | 0.79 |
| PHOSPHOROUS-FIXING RATE [%] | | 63 | 71 | 68 |

TABLE 2

| | UNIT | 4 | 5 | 6 REFERENCE |
|---|---|---|---|---|
| FIRE-RATED FINISHING PRODUCT OF THE INVENTION | G/L | 600 | 600 | 0 |
| PYROVATEX CP NEW (REFERENCE) | G/L | 0 | 0 | 400 |
| KNITTEX MLF NEW (RESIN) | G/L | 0 | 0 | 50 |
| INVADINE PBN | G/L | 5 | 5 | 5 |
| $NH_4H_2PO_4$ (20%) | G/L | 150 | 0 | 0 |
| PHOSPHORIC ACID 85% | G/L | 10 | 15 | 24 |
| WORKING PROCESS | | PAD → DRY → CURE 10 MIN 165° C. SURFACE TEMPERATURE | PAD → DRY → CURE 10 MIN 165° C. SURFACE TEMPERATURE | PAD → DRY → CURE 5 MIN 150° C. SURFACE TEMPERATURE |
| PICK UP: 100% CO TWILL/ 249 G/M ID: 001-CO/240 BE $14^2$ | | 82% | 82% | 82% |
| WASH-OFF: | | SEPARATE 10 G/L SODA ASH LR 1:20 20 MIN AT 60° C. RINSE WARM, COLD | SEPARATE 10 G/L SODA ASH LR 1:20 20 MIN AT 60° C. RINSE WARM, COLD | SEPARATE 10 G/L SODA ASH LR 1:20 20 MIN AT 60° C. RINSE WARM, COLD |

TABLE 2-continued

| | UNIT | 4 | 5 | 6 REFERENCE |
|---|---|---|---|---|
| PH-VALUE/FLOTTE | | 3.4 | 2.4 | 2.2 |
| P CONTENT | | P [%] | P [%] | P [%] |
| INITIAL | | 2.04 | 1.31 | 1.76 |
| AFTER 25 × 60° C. 2A (WASHCATOR/SAPTON) | | 2.22 | 1.30 | 1.55 |
| N CONTENT | | N [%] | N [%] | N [%] |
| INITIAL | | 0.85 | 0.65 | 1.18 |
| AFTER 25 × 60° C. 2A (WASHCATOR/SAPTON) | | 0.88 | 0.59 | 0.92 |
| PHOSPHOROUS-FIXING RATE [%] | | 68 | 44 | 54 |

The working process mentioned in the tables above requires a temperature at the surface of 165° C., which can be obtained by using, for example Mathis air circulation from Mathis AG company.

Pick up data relates to 100 g of dry fabric pick up 82 g of the application fleet.

Table 3 below illustrates the edge ignition burning test according to EN ISO 15025 of the above samples.

TABLE 3

| Burning behavior EN ISO 15025 | | | | | | |
|---|---|---|---|---|---|---|
| | FAT | | | | | |
| | 10 sec | | | 10 sec | | |
| | Edge ignition | | | Edge ignition | | |
| | Initial | warp | weft | 25 × 60° C. | warp | weft |
| Sample 1 | | | | | | |
| AFT | | 0 | 0 | | 0 | 0 |
| AGT | | 0 | 0 | | 0 | 0 |
| DL | | 105 | 95 | | 95 | 95 |
| Sample 2 | | | | | | |
| AFT | | 0 | 0 | | 0 | 0 |
| AGT | | 0 | 0 | | 0 | 0 |
| DL | | 95 | 100 | | 90 | 95 |
| Sample 3 | | | | | | |
| AFT | | 0 | 0 | | 0 | 0 |
| AGT | | 0 | 0 | | 0 | 0 |
| DL | | 100 | 95 | | 105 | 105 |
| Sample 4 | | | | | | |
| AFT | | 0 | 0 | | 0 | 0 |
| AGT | | 0 | 0 | | 0 | 0 |
| DL | | 100 | 90 | | 95 | 95 |
| Sample 5 | | | | | | |
| AFT | | 8 | 7 | | 8 | 7 |
| AGT | | | | | | |
| DL | | Fully damaged | Fully damaged | | Fully damaged | Fully damaged |
| Sample 6 | | | | | | |
| AFT | | 0 | 0 | | 0 | 0 |
| AGT | | 0 | 0 | | 0 | 0 |
| DL | | 110 | 100 | | 100 | 110 |

FAT = flame application time
AFT = after flame time (second)
DL = damaged length (mm)
sec. = seconds The fixing rate can be calculated as follows:

100 g cotton textile pick up 82 g (=42 g solid=4.3 g P) of the aqueous preparation.

Fixing rate=P-content (after wash-off process)*100/P-content (before wash-off process).

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the appended claims, any of the claimed embodiments can be used in any combination.

As used herein, the singular forms "a", "an", and "the" include both singular and plural referents unless the context clearly dictates otherwise. By way of example, "an isocyanate group" means one isocyanate group or more than one isocyanate group.

The terms "comprising", "comprises" and "comprised of" as used herein are synonymous with "including", "includes" or "containing", "contains", and are inclusive or open-ended and do not exclude additional, non-recited members, elements or method steps. It will be appreciated that the terms "comprising", "comprises" and "comprised of" as used herein comprise the terms "consisting of", "consists" and "consists of". This means that, preferably, the aforementioned terms, such as "comprising", "comprises", "comprised of", "containing", "contains", "contained of", can be replaced by "consisting", "consisting of", "consists".

Throughout this application, the term "about" is used to indicate that a value includes the standard deviation of error for the device or method being employed to determine the value.

As used herein, the terms "% by weight", "wt %", "weight percentage", or "percentage by weight" are used interchangeably.

The recitation of numerical ranges by endpoints includes all integer numbers and, where appropriate, fractions subsumed within that range (e.g. 1 to 5 can include 1, 2, 3, 4 when referring to, for example, a number of elements, and can also include 1.5, 2, 2.75 and 30 3.80, when referring to, for example, measurements). The recitation of end points also includes the end point values themselves (e.g. from 1.0 to 5.0 includes both 1.0 and 5.0). Any numerical range recited herein is intended to include all sub-ranges subsumed therein.

All references cited in the present specification are hereby incorporated by reference in their entirety. In particular, the teachings of all references herein specifically referred to are incorporated by reference.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

Throughout this application, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous. Although the preferred embodiments of the invention have been disclosed for illustrative purpose, those skilled in the art will appreciate that various modifications, additions or substitutions are possible, without departing from the scope and spirit of the invention as disclosed in the accompanying claims.

The invention claimed is:

1. A fire-rated finishing product suitable for fabric applications of the following formula I:

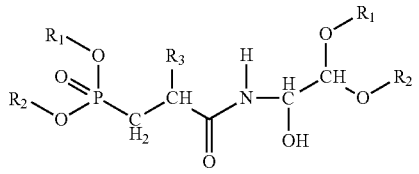

Wherein, $R_1$, $R_2$ are each a group equal to $—C_nH_{2n+1}$, wherein n ranges from 1 to 4, and
wherein $R_3$ is H or methyl group.

2. The product according to claim 1, obtainable by the following steps:

Providing a phosphorus-containing compound having the following formula II:

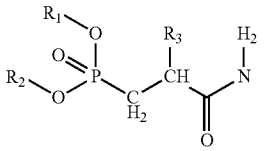

Wherein, $R_1$, $R_2$ are each a group equal to $—C_nH_{2n+1}$, wherein n ranges from 1 to 4, and
wherein $R_3$ is H or methyl group;

Reacting the compound of said formula II with the following acetaldehyde compound having formula III:

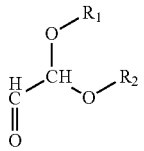

Wherein, $R_1$, $R_2$ are each a group equal to $—C_nH_{2n+1}$, wherein n ranges from 1 to 4.

3. The product according to claim 2, wherein said acetaldehyde compound is 2,2-dimethoxyacetaldehyde.

4. The product according to claim 2, wherein, when said compound of formula III is reacted with said compound of formula II, the pH is adjusted to a value ranging from 7 to 10.

5. The product according to claim 2, wherein the yield of the reaction between said compounds of formula II and III is of at least 70%, measured by HPLC.

6. The product according to claim 2, wherein the reaction between said compounds of formula II and III is carried out at a temperature ranging between 40 to 80° C.

7. The product according to claim 2, wherein the reaction between said compounds of formula II and III is carried out during a period of time ranging from 0.5 to 4 hours.

8. The product according to claim 2, wherein the reaction between said compounds of formula II and formula III is carried out at a mole ratio ranging from 0.7 to 1.3.

9. The product according to claim 2, being substantially free of any added amount of formaldehyde or any formaldehyde derivatives.

10. The product according to claim 2, wherein formula II is obtained by applying the following steps:

Reacting a compound having following formula IV:

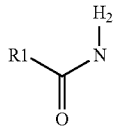

wherein, $R_1$ is a hydrocarbon chain which comprises at least one carbon-carbon-double bond, with a compound having the following formula V:

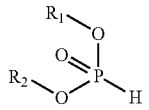

wherein, $R_1$, $R_2$ are each a group equal to $—C_nH_{2n+1}$, wherein n ranges from 1 to 4.

11. A process for processing cellulose-containing material comprising the following steps:

Mixing a product according to claim 1, with an aqueous solution containing a catalyst, which comprises ammonium phosphate compound, or a mixture of catalysts in aqueous solution, which comprises ammonium phosphate compound and at least one pentavalent organic phosphorus compound, Applying the obtained composition on the cellulose-containing material and curing at a predetermined temperature.

12. The process according to claim 11, wherein the ammonium phosphate compound is selected from the list comprising ammonium phosphate, diammonium phosphate, monoammonium phosphate and mixtures thereof.

13. The process according to claim 11, wherein said ammonium phosphate compound, is present in an amount ranging from 1 to 20 g/L, based on the total amount of said composition.

14. The process according to claim 11, wherein the phosphorus fixing rate of said obtained composition onto the cellulose-containing material is of at least 65%.

15. The process according to claim 11, wherein the application of said obtained composition on said cellulose-containing material is carried out at a pH of above 3.

16. Cellulose-containing material obtained by the process according to claim 11, wherein said cellulose-containing material is substantially free of any added amount of formaldehyde or any formaldehyde derivatives.

* * * * *